US005340191A

United States Patent [19]

May

[11] Patent Number: 5,340,191

[45] Date of Patent: Aug. 23, 1994

[54] RECLINING CHAIR HAVING POP-UP HEADREST

[75] Inventor: Teddy J. May, Tupelo, Miss.

[73] Assignee: The Lane Company, Inc., Altavista, Va.

[21] Appl. No.: 43,561

[22] Filed: Apr. 7, 1993

[51] Int. Cl.[5] ..... A47C 1/036

[52] U.S. Cl. ..... 297/61; 297/403

[58] Field of Search ..... 297/61, 403

[56] References Cited

U.S. PATENT DOCUMENTS

| | | | |
|---|---|---|---|
| 2,996,332 | 8/1961 | Kurtyka et al. | 297/61 |
| 3,005,660 | 10/1961 | Winick | 297/61 |
| 3,132,894 | 5/1964 | Schliephacke | 297/61 |
| 3,871,704 | 3/1975 | Shoemaker et al. | 297/61 |
| 3,871,705 | 3/1975 | Harrison | 297/61 |
| 3,958,827 | 5/1976 | Re | 297/61 |
| 4,362,446 | 12/1982 | Zapf et al. | 297/317 |
| 4,451,081 | 5/1984 | Kowalski | 297/61 |
| 4,691,961 | 9/1987 | Rogers, Jr. et al. | 297/61 |
| 4,718,716 | 1/1988 | Stumpf et al. | 297/85 |
| 4,830,429 | 5/1989 | Petitjean | 297/61 X |
| 5,000,510 | 3/1991 | Lafer | 297/84 |

*Primary Examiner*—Peter R. Brown

*Attorney, Agent, or Firm*—Cushman Darby & Cushman

[57] ABSTRACT

The left and right side linkages of a mechanism for a reclining chair are provided with respective pantographic linkage systems. An actuator link is provided for each, which causes the headrest which is mounted to the upper end of each such linkage system to rotate relatively forwards by about 90 degrees as the backrest is reclined as the chair goes from its fully erect to its TV and fully reclined positions. The mechanism provides low back, wall-saver operation for the chair reclining function without necessitating a thick or oddly appearing style.

4 Claims, 6 Drawing Sheets

RECLINING CHAIR HAVING POP-UP HEADREST

BACKGROUND OF THE INVENTION

The designers of mechanisms for reclining chairs perennially seek to overcome certain styling constraints which the use of conventional reclining chair mechanisms place on the 'looks' of reclining chairs.

Reclining chairs typically have tall backs, so that the user's head will be cradled on the headrest pillow as the chair goes from its fully erect into its TV and fully reclined positions.

In order to overcome styling constraints necessitated by tall backs, low back recliners with pop-up headrests heretofore have been designed. A pop-up headrest typically stores retracted in the backrest or in a folded-over condition, then projects or rotates to an extended condition as the chair back is rotated down from a fully erect condition.

Conventional reclining chairs also typically need to be situated a substantial distance away from a wall or other furniture that is behind them, so that as their backs recline, the upper ends of the backs do not hit the wall or other furniture.

Low back recliners are one way to solve the wall-spacing problem, since a low back does not protrude so far rearwardly when it is reclined as does a tall back.

Wall-saver recliner designs represent another way to solve the wall-spacing problem. On such chairs, the seat and arm frame to which the back is mounted, shifts a substantial distance forwards as the backrest reclines, so that the top of the backrest never moves much nearer to the wall than where it is when the backrest is fully erect.

A third design prior art attempt to solve the problem comprises a combination of a low back, a wall-saver mechanism, and a pop-up headrest. Such a combination has been attempted, but has tended to be complex, and impose other unwanted restrictions on the looks of the chairs, for instance, that the chair backrest be unusually thick and/or that the movable frame be unusually split into two portions which must be moved relative to one another for popping-up and stowing the headrest.

SUMMARY OF THE INVENTION

The left and right side linkages of a mechanism for a reclining chair are provided with respective pantographic linkage systems. An actuator link is provided for each, which causes the headrest which is mounted to the upper end of each such linkage system to rotate relatively forwards by about 90 degrees as the backrest is reclined as the chair goes from its fully erect to its TV and fully reclined positions. The mechanism provides low back, wall-saver operation for the chair reclining function without necessitating a thick or oddly appearing style.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
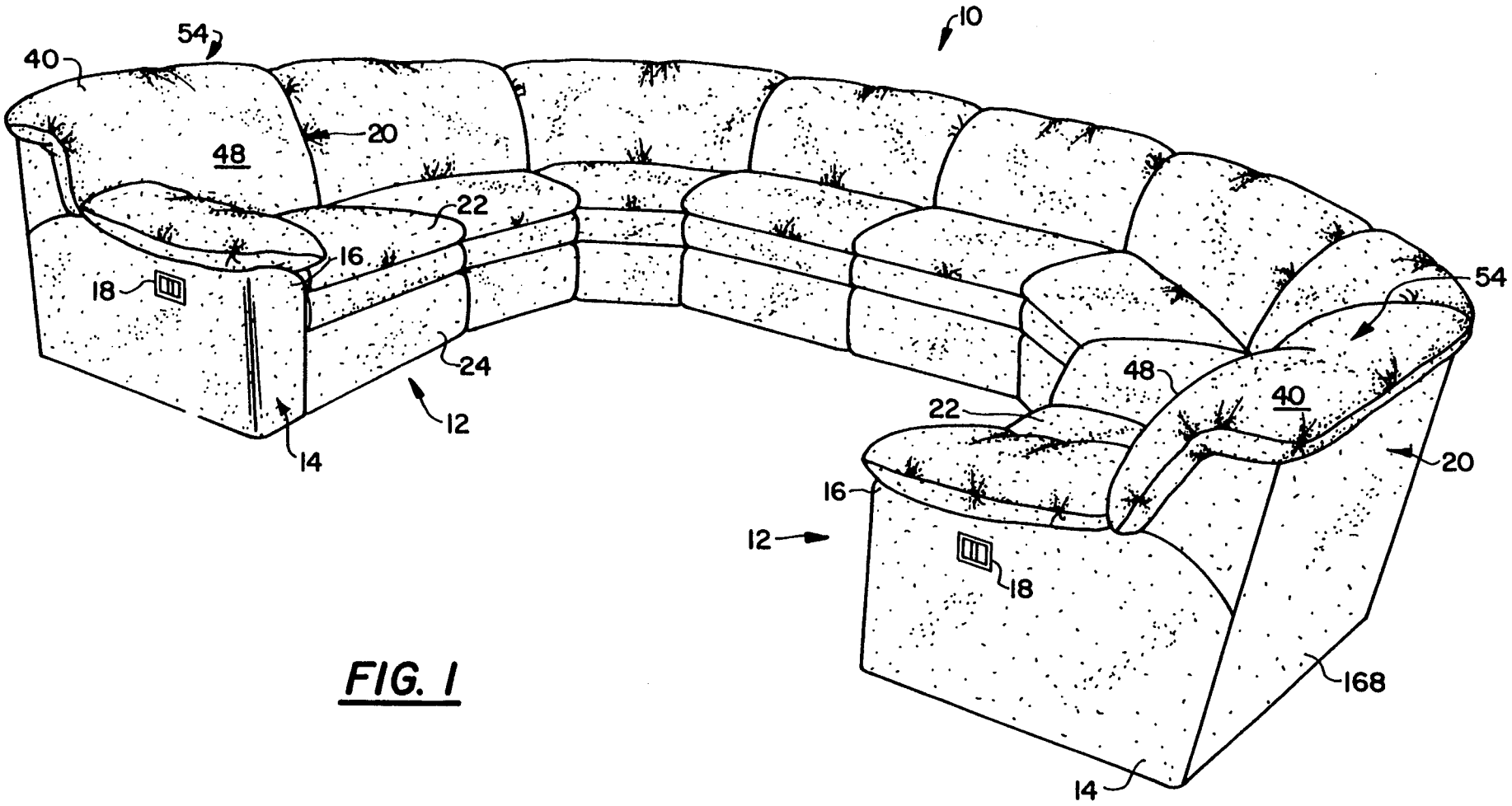
FIG. 1 is a perspective view of a sectional sofa in which the two end units are provided as reclining chairs (which are mirror images of one another), each of which is provided with a pop-up mechanism in accordance with the principles of the present invention.

A sectional sofa 10 is shown in FIG. 1. In the instance depicted, the sectional sofa is one comprising end units 12 which are actually reclining chair units, that are mirror images of one another. Because the units 12 are shown as part of a sectional sofa, the seat and arm frame unit 14 of each includes but a single, outer end arm rest 16. In fact, this is happenstantial; the principles of the invention are equally applicable to a freestanding reclining chair having armrests at both ends. In either event, the armrest 16 at one end is shown provided with a lever-type actuator 18, the recessed, spring-biased latch handle of which can be pulled for releasing the mechanism (not shown in FIG. 1) to permit the chair to progressively open up from its fully erect position (shown in FIGS. 1, 2 and 5–7) to its TV position (shown in FIG. 3), and its fully reclined position (shown in FIG. 4). Opening up the chair after its mechanism has been unlatched is accomplished by the seated user by leaning back on the backrest 20 while pushing forward on the armrest 16 (or armrests, in the case of a freestanding chair).

Re-erection of the chair from its fully reclined to its TV position and/or from its TV position to its fully erect position is accomplished by the seated user's shifting their weight forward onto the seat cushion 22 while pulling back on the armrest 16 and while pulling back on the primary legrest 24 with the backs of their ankles or leg calves.

(The above-described procedures sound more complicated than they really are. Many recliner chairs work this way, and users are either already adept at successfully accomplishing them, or soon master these procedures.)

A reclining chair having recessed lever-type actuator of the type just described is more extensively shown and described in the U.S. Pat. of May et al., No. 5,056,862, issued Oct. 15, 1991.

Each chair 12 further includes a base 26 meant to be supported on a floor. Sometimes (when a reclining chair is freestanding, rather than being part of a sectional sofa), its base 26 rests on the floor through the intermediacy of a swivel assembly which, much like a table-top lazy susan, permits an upper plate to be freely rotated through 360 degrees about a vertical axis relative to a stationary lower plate. In the instance of a swivel chair, the base 26 is mounted on the upper plate of the swivel assembly. Because the base 26 is in any event stationary relative to whatever it is mounted on (whether directly on the floor or indirectly on the floor by being directly on the upper plate of the swivel assembly, the base 26 is referred to as being a stationary base.

Each chair 12 further includes a reclining mechanism 28 which includes left side linkage 30 and a right side linkage 32 (which are basically mirror images of one another) except for features which integrate the actuator 18 to the mechanism 28. The mechanism 28 further includes lateral (transverse) rod, tube and/or bar elements 34 which interconnect corresponding elements of the side linkages 30, 32 so as to coordinate movement thereof.

The left and right side linkages are also functionally interconnected by being mounted to corresponding sites on the seat and arm frame unit 14, the back rest 20, the base 26, the primary legrest 24, and, if provided, the secondary legrest 36. These connections are made using conventional nut and bolt assemblies, lag screws or other suitable fasteners (most of which, being utterly conventionally constructed and used, are not illustrated in detail).

The chair 12 preferably is completely made of conventional materials (wooden frame elements glued and mechanically fastened together), padding, upholstery, and stamped, pressed, bored and/or sheared steel plate, painted flat black and joined and fastened with mechanical joints and fasteners. Most, if not all, movable joints are provided by respective transverse, horizontal axis pivot joints, which, as necessary, may include metal and/or lubricous plastic washers and/or spacers. As is known in the art, tension coil springs may be provided for bracing some portions of the mechanism towards desirable orientations, e.g., for maintaining the primary legrest tight against the lower front of the seat and arm frame unit when the legrest is in its stowed position.

Figure 2:
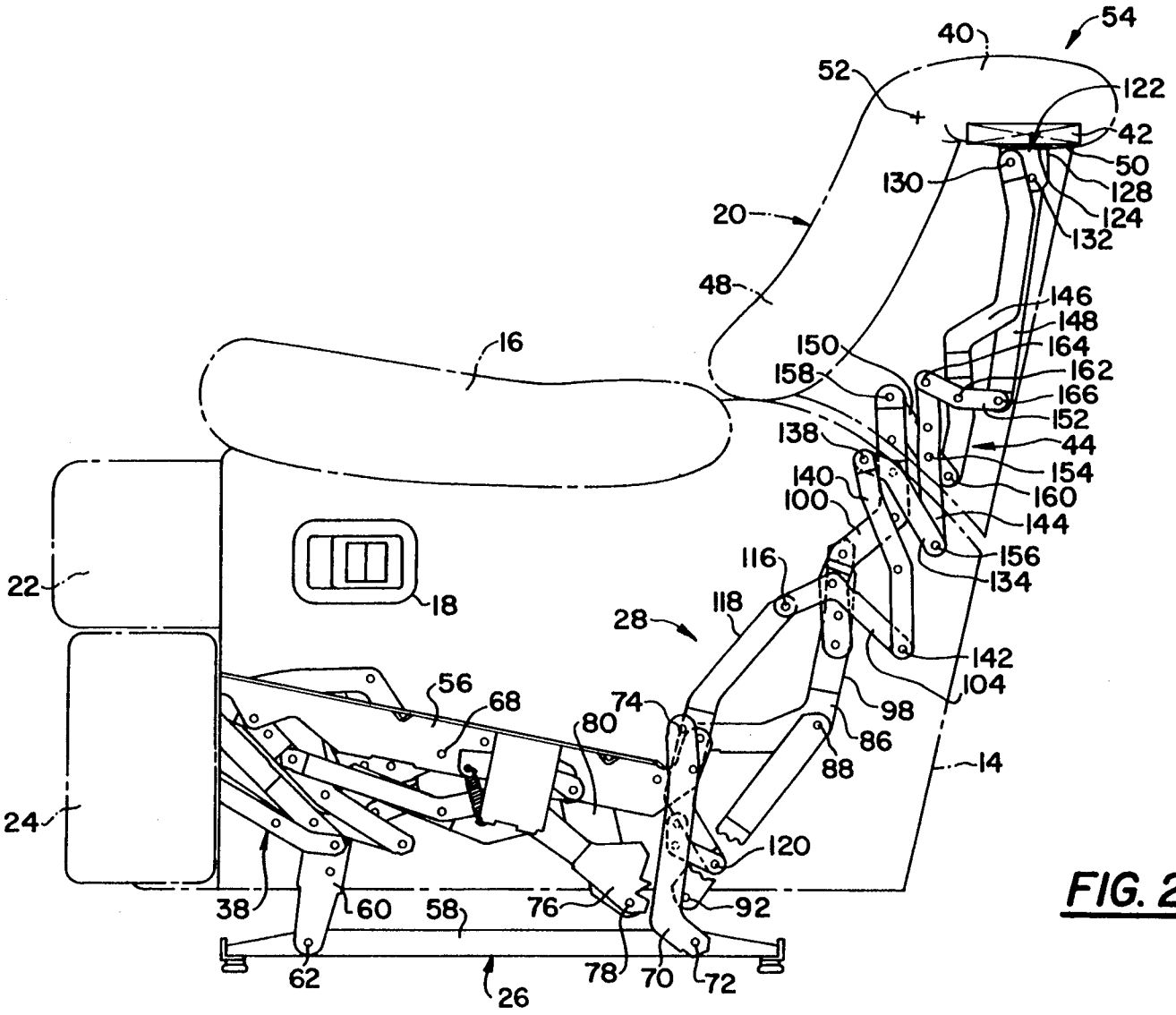
FIG. 2 is a side elevational view of the left side linkage for the reclining chair at the right of the sofa as shown in FIG. 1, shown superimposed on the chair, with a portion of the side linkage disappearing from view behind a side wing of the legrest, the chair (and side linkage), being shown in positions corresponding to the fully erect position of the chair, the right side linkage (not shown) being a mirror image of the left side linkage shown.
Figure 3:
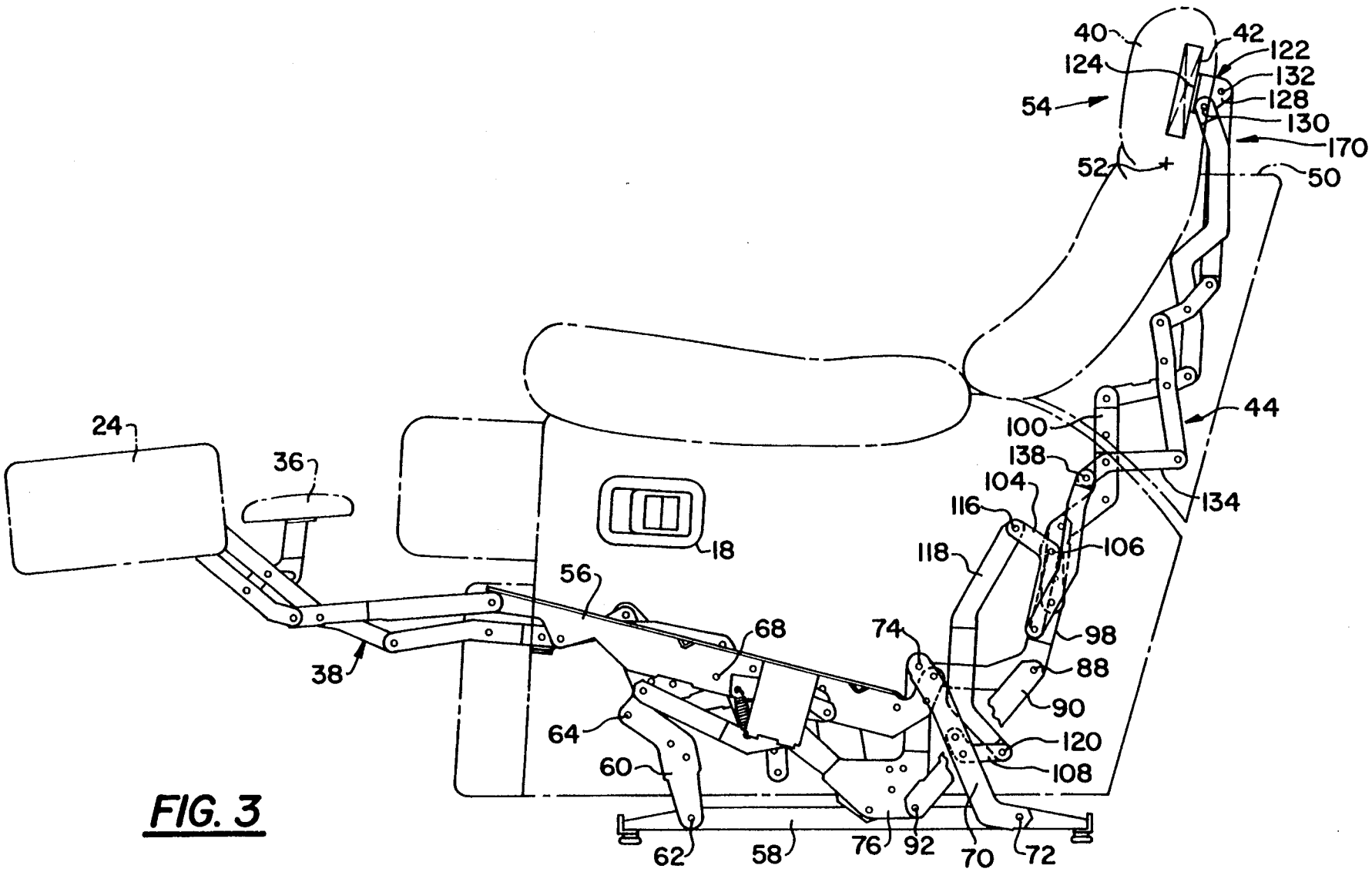
FIG. 3 is a schematic side elevational view similar to FIG. 2, but showing the mechanism and chair in positions corresponding to the TV position of the chair (i.e., footrest fully extended and seat and arm frame unit lowered and shifted forwards relative to the chair base, but the backrest not yet reclined relative to the seat and arm frame unit, the pop-up headrest having rotated from its stowed position shown in FIG. 1, to its active position.

Because the mechanism 28 is based on a conventional one, the appearance, construction and operation of which is well known, the conventional features will not be redescribed in detail here. Suffice it to say that when a person sitting in the fully erect chair of FIGS. 1, 2 and 5–7, pulls out on and lets go of the spring-biased, recessed ring pull of the actuator 18, while pushing back on the backrest and armrest, the mechanism 28 becomes unlatched and reclining begins. At first, the front pantographic link assemblies 38 of the side linkages raise and thrust forward the legrest or legrests. At this same time, the seat and arm frame unit and backrest are bodily shifted forwards relative to the chair base. Thus, the TV position shown in FIG. 3 is achieved. (In chairs which are also adapted for rocking (the one shown isn't) at the same time that the person's feet are lifted from the floor by raising and thrusting of the legrest(s), a rocker blocking arrangement forming part of the mechanism in that instance, is activated, so as to prevent the suspended part of the chair from being able to rock relative to the base while the person's legs are up in the TV position.)

Figure 4:
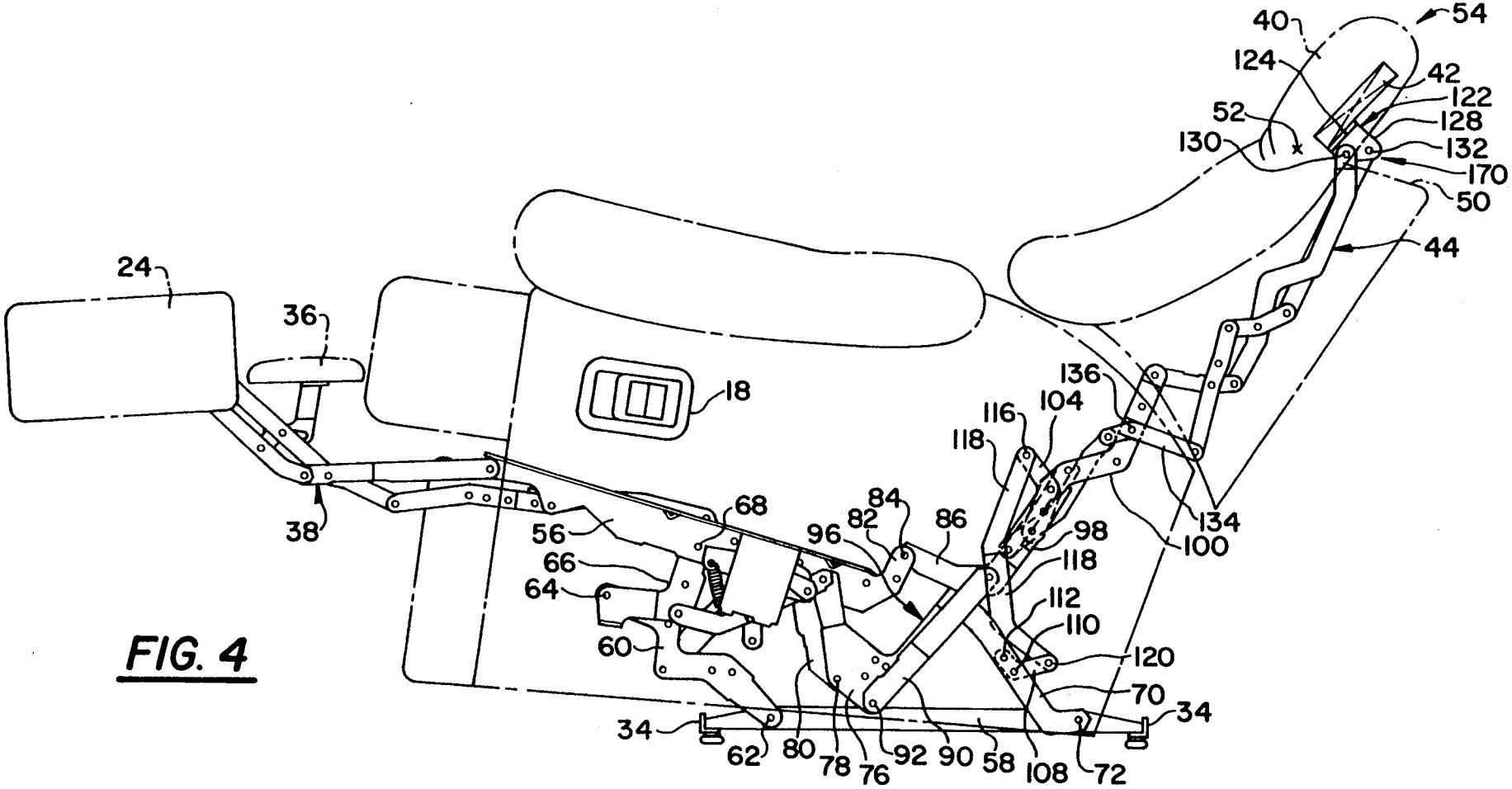
FIG. 4 is a schematic side elevation view similar to FIG. 3, but showing the mechanism and chair in positions corresponding to the fully reclined position of the chair.

Should the user wish to recline further from the TV position, all they need to do is to push back further (in certain instances, after again releasing the mechanism by pulling on the handle of the actuator 18), whereupon the chair back reclines from its FIG. 3 position to its FIG. 4 position.

The features, so far described, are conventional and do not distinguish the chair of the present invention from the prior art.

The aspects of the chair 12 that cause it to distinguish from conventional chairs are best seen in FIGS. 2–7.

In general, an upholstered upper end portion 40 of the backrest 20 embeds a transversally extending board 42, to which the upper ends of rear pantographic link assemblies 44 of the left and right side linkages 30, 32 are pivotally secured. Although the board 42 could be hinged along a transverse, horizontal axis hinge to the frame 46 of the backrest 20, in practice, it is usually sufficient that the upholstered back cushion 48 of the backrest 22 extend upwards beyond the upper end 50 of the frame 46 of the backrest 20, and be sufficiently limp or flexible, that it can self-hinge, e.g., about the axis indicated by the cross-mark 52, so that the upper end portion 40 of the pillow can either rest on a lowered, rearwardly directed position on the upper end 50 of the backrest frame, with the board 42 being generally horizontal and resting on the upper end 50 of the frame 46 of the backrest 20, or project upwards, supported from the rear by the board 42, with the board being uplifted to a generally vertical, on edge, orientation, due to relative pantographic expansion of the rear pantographic link assemblies 44, from a retracted condition. The link assemblies 44 are caused to expand as the chair moves from its fully erect position (FIG. 2) to its TV position (FIG. 3). The expanded condition remains so long as the chair is in its TV position (FIG. 3), and if the chair is moved to and from its fully reclined position (FIG. 4), and does not reassume its retracted position (resulting in tilting down of the headrest 54, unless and until the chair is moved from its TV position (FIG. 3) to its fully erect position (FIG. 2).

Although it is easily conceivable that reclining chair mechanism designers and manufacturers, given the drawings of this document and the information that has been provided, so far, would easily be able to construct and successfully operate for its intended purpose a reclining chair having a pop-up headrest in accordance with the principles of the present invention, in the remainder of this detailed description, some further details of the preferred embodiment will be described, in order to further clarify the construction and operation of the preferred embodiment.

It is not necessary to understand in detail how each piece of the conventional basic portion of the mechanism 28 is configured and connected to each other piece in order to fully appreciate how the pop-up portion provided by the invention is constructed and operated, so the conventional portion, although shown, will not be exhaustively described. Indeed, the conventional portion has been commercially available and, therefore, is within the knowledge of those skilled in the art.

Suffice it to say that each side linkage 30, 32 includes an upper longitudinal flange 56 to which a respective side of the seat and arm frame unit 14 is secured, and a lower longitudinal flange 58 which, in use, is secured to or forms part of the base 26.

A front, generally vertical support strut 60 has its lower end pivoted at 62 to the lower longitudinal flange 58, and its upper end pivoted at 64 to the front end of the L-shaped link 66, the rear end of which is pivoted at 68 to an intermediate location on the seat and arm frame unit mounting flange 56.

A rear, generally vertical support strut 70 has its lower end pivoted at 72 to the lower longitudinal flange 58, and its upper end pivoted at 74 to the upper, rear end of an L-shaped link 76, an intermediate location on the lower, forwardly projecting leg of which is pivoted at 78 to the lower end of an inverted L-shaped plate 80 which is rigidly secured to (and so, in effect, forms a rear and lower part of) the upper longitudinal flange 56.

As the chair is operated to move from its fully erect position (FIG. 2) to its TV position (FIG. 3), both of the support struts 60 and 70 are rotated forwards about the pivot joints 62, 72 at their lower ends, thereby causing the seat and arm frame unit 14 (and the backrest 20) to move forwardly (about three inches) and down (about 1.5 inches measured at the rear of the seat cushion, but much less or none as measured at the front of the seat cushion, with the net effect that the person is moved forwards and down and slightly rotated rearwards about their own center of gravity).

Continuing to describe one side linkage as representative of both: at its rear end, the upper longitudinal flange 60 has an upwardly projecting spur 82 providing a pivot joint 84 for the front end of the forwardly projecting lower leg of an L-shaped backrest mounting link 86. The knee of the L-shaped link 86 is pivotally connected at 88 to the upper end of a backrest operating link 90, the lower end of which is pivotally connected at 92 to the knee of the L-shaped link 76. The lower end of the backrest is rigidly secured at a respective side thereof to the backrest mounting link 86, e.g., at 94.

The backrest 20 does not move relative to the seat and arm frame unit 14 as the chair is operated to move from the fully erect position (FIG. 2) to the TV position (FIG. 3), and back.

However, due to a linkage assembly generally indicated at 96, once the chair begins to be operated, to move from the TV position (FIG. 3) to the fully reclined position (FIG. 4), the two L-shaped links 66 and 76 which connect the upper ends of the support struts 60 and 70 with the upper longitudinal flange relatively rotate about their respective pivot joints at both ends thereof between the struts 60, 70 and the upper longitudinal flange 56.

As a result, the seat and arm frame unit 14 moved forwards (about three inches), and upwards (about an inch), and the backrest mounting bracket (and, therefore, the backrest) is caused to rotate rearwards (through about 20 degrees) about its knee, while being translated forwards (about two inches). As the chair is erected from its FIG. 4 position, a reverse of the above-described movements takes place.

Again the foregoing elements of the mechanism 28 (but for the rear pantographic link assemblies 44 and pivotable headrest 54) are conventional and have been described in order to set the stage for the description of the added or modified elements which operate the pop-up headrest 54.

If the mechanism 28 were designed from scratch to be a pop-up headrest mechanism, some of its elements could be integrally formed with those that have been described above, but, because the invention in the practical embodiment shown, arose as an elaboration based on an existing mechanism, some of the additional structure is secured to the conventional structure, as, in effect, additions or adaptations. Either way of construction is within the contemplation of the invention.

First, the upwardly projecting rear leg 98 of the backrest mounting link is, in effect, extended upwards by a plate 100 which is rigidly secured to the leg 98, e.g., by bolts 102. An upper L-shaped link 104, which has a longer rear leg than front leg and is concave downwards, is pivotally connected at its knee (at 106) to the plate 100 below the upper end of the backrest mounting link 86.

A lower L-shaped link 108, which has a longer front than rear leg and is concave upwards, is rigidly connected at its knee (at 110) to an intermediate-height location on the rear support strut 70. The front end of the link 108 is also rigidly connected (at 112) to the strut 70, so that the rear end of this link is cantilevered rearwardly.

The front end of the upper L-shaped link 104 is pivotally connected at 116 to the upper end of a headrest operator link 118, the lower end of which is pivotally connected at 120 to the cantilevered rear end of the lower L-shaped link 108.

At the upper end of the rear pantographic link assembly 44 is an L-shaped bracket 122, to which a medially directed flange 124 of which a respective one end of the board 42 is secured, e.g., by mechanical fasteners. The longitudinal flange 128 of the bracket 122 has a forward pivotal connection 130 and a rear pivotal connection 132.

The headrest 54 is caused to pop up (as the chair moves from its FIG. 2 to its FIG. 3 position) and to lie back down (as the chair moves from its FIG. 3 position back to its FIG. 2 position), by propagating along the rear pantographic link assembly 44 the effect of causing the link 118 to rotate the upper L-shaped link 104 front leg up-rear leg down (to erect the headrest) and rear leg down-front leg up (to lay down the headrest). The link 118 is caused to move by virtue of heretofore described forward and rearward pivoting of the rear support strut 70 about its lower end. All of this motion of the rear pantographic linkage assembly is effected as the chair moves from its FIG. 2 position to its FIG. 3 position, and back. No further erection or initiation of laying down of the headrest is effected as the chair moves from its FIG. 3 position to its FIG. 4 position, and back, despite the fact that the rear support strut does rotate further during these segments of the chair's operation. (Due to mechanism geometry, no further rotation of the upper L-shaped link 104 about the pivotal connection at its knee takes place during these segments of the chair operation.

The effect of propagating the rotation of the link 104 about the connection 106, is to lower and raise the rear pivot joint 132 relative to the forward pivot joint 130, thereby rotating the flange 122 between the FIG. 2 and FIG. 3 positions thereof.

As those skilled in the art will appreciate, many, varied pantographic linkage systems, equivalent in effect, could be provided for effecting the aforedescribed propagation of rotation. An exemplary, and preferred one is shown.

In the illustrated embodiment, a first cross link 134 is pivoted at 136 intermediate its ends, to an intermediate site on the plate 100 below the upper end of the plate 100, but above the upper end of the leg 98 of the backrest mounting link 86. The front end of the first cross link 134 is pivotally connected at 138 to the upper end of a first, lower long link 140, the lower end of which is pivotally connected at 142 to the rear end of the upper L-shaped link 104.

The illustrated rear pantographic linkage assembly further includes a second long link 144, a third long link 146 and a fourth long link 148, all of which are generally vertical and generally parallel to one another, so that each has an upper end and a lower end.

The illustrated rear pantographic linkage assembly further includes a second cross link 150 and a third cross link 152; the bracket 122, in effect, constitutes a fourth cross link.

The second cross link 150 is pivotally connected (at 154) at site intermediate its front and rear ends, to an intermediate site on the second long link 144. The lower end of the second long link is pivotally connected, at 156, to the rear end of the first cross link 134.

The front end of the second cross link is pivoted, at 158, to the upper end of the backrest mounting link extension plate 100.

The rear end of the second cross link is pivoted, at 160, to the lower end of the third long link 146.

The third cross link 152 is pivotally connected (at 162) at an intermediate site thereon, to an intermediate site on the third long link 146.

The front end of the third cross link 152 is pivoted, at 164, to the upper end of the second long link 144.

The rear end of the third cross link 152 is pivoted, at 166, to the lower end of the fourth long link 148.

Finally, the upper ends of the third and fourth long links 146 and 148 are pivotally connected to the longitudinal flange 128 of the bracket 122, respectively, by the forward pivot 130 and the rear pivot 132.

The rigidity of the board 42 of the headrest tends to coordinate movement of the pantographic rear linkages 44 on the two sides of the chair.

Figure 5:
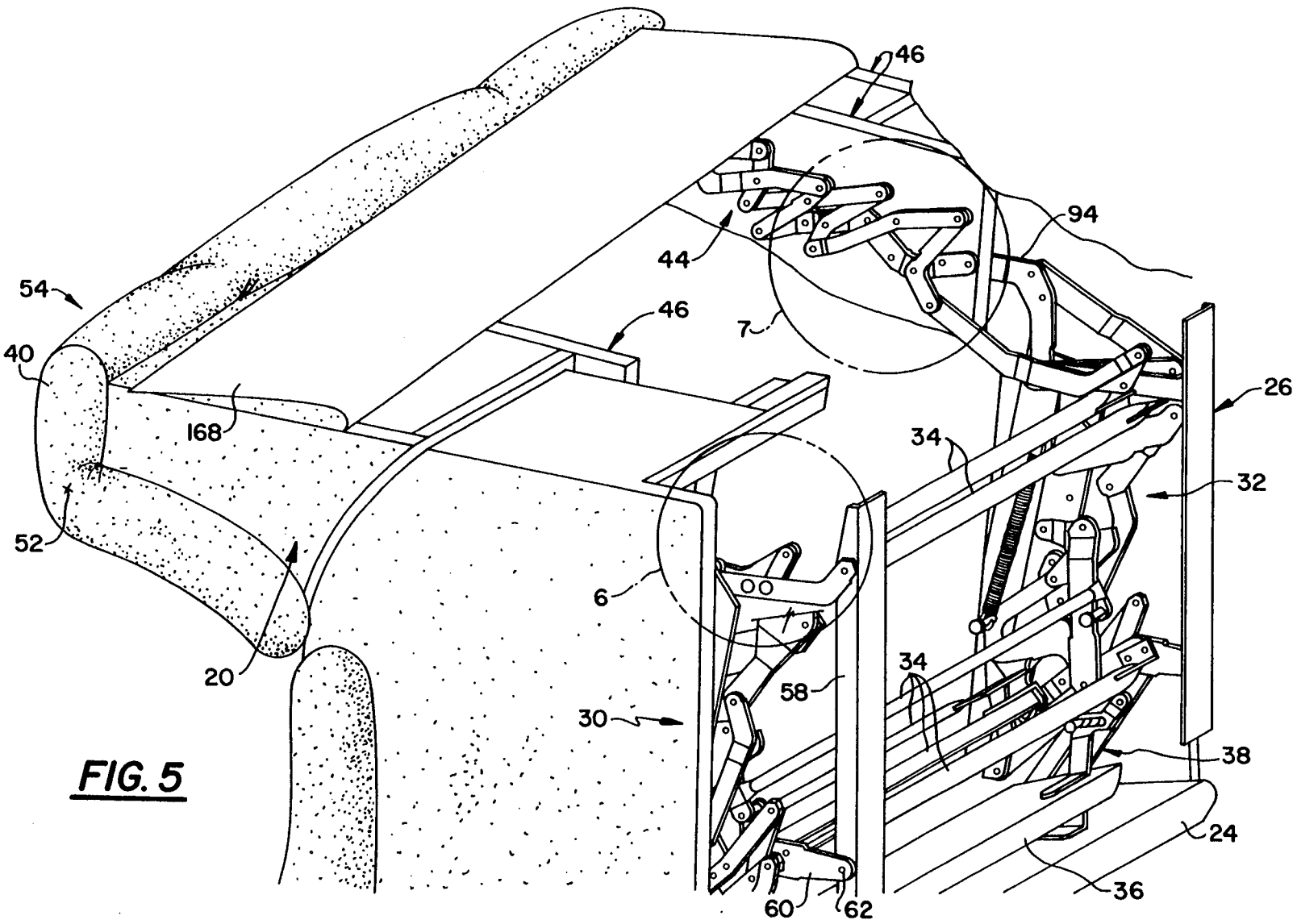
FIG. 5 is drawn from an unusual perspective. It shows a reclining chair constructed in accordance with principles of the present invention, in fragmentary perspective from the bottom, left side and back, as if the chair were tipped over forwards onto the front edge of its seat cushion, and the upholstery on the rear of its backrest pulled away from the frame from the bottom and doubled-up upon itself so as to expose details within the chair back that otherwise would be hidden.
Figure 7:
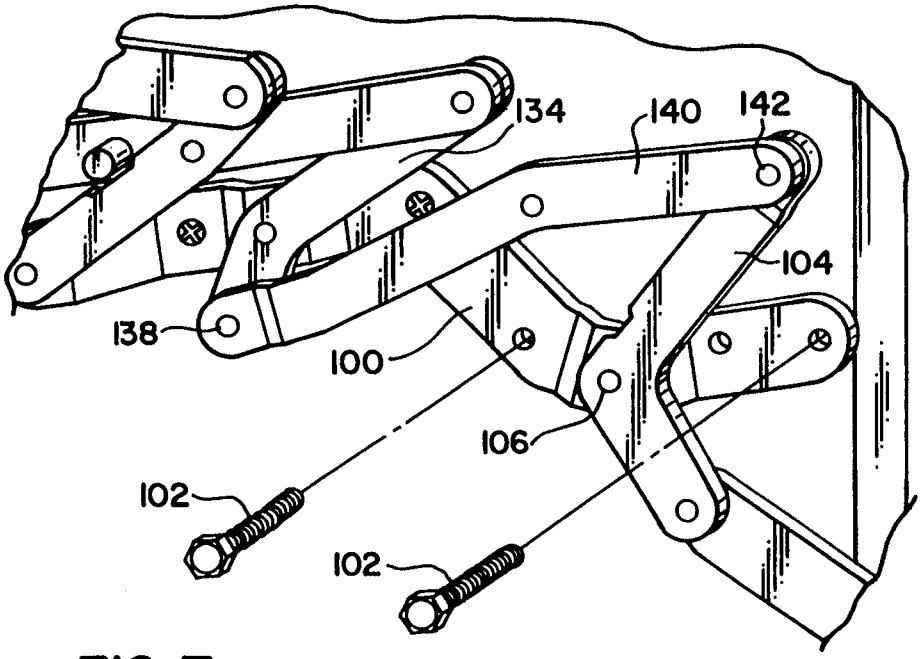
FIG. 7 is a fragmentary exploded perspective view of a second circled portion of FIG. 5.
Figure 6:
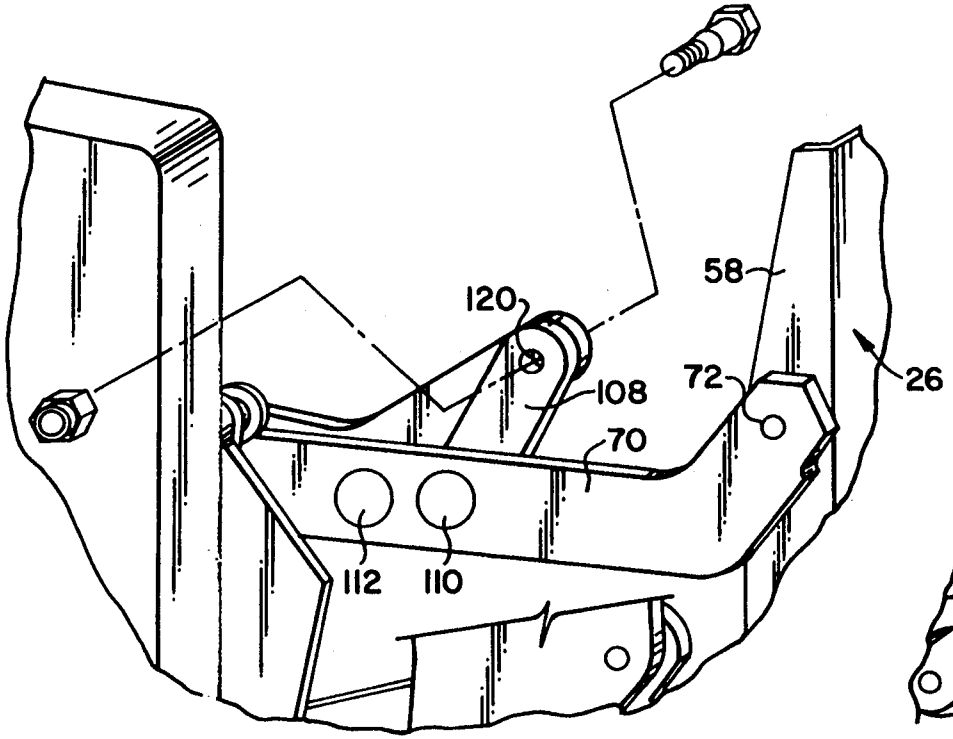
FIG. 6 is a fragmentary exploded perspective view of a first circled portion of FIG. 5.

As best shown in FIG. 5, the rear pantographic linkages are hidden within the backrest 20 of the chair, next to longitudinal framing 46 of the backrest, and normally hidden from view by the upholstery flap 168, except for the small upper portions 170 which penetrate through a slot or slots in the upholstery at the top of the frame 46 (and so could be seen from the rear of the chair while the headrest is in its popped-up position).

The invention, in its preferred form, thereby provides a pop-up headrest mechanism and reclining chair, in which the pop-up feature is provided by rear pantographic linkages that work off of the rear support struts for the seat and arm frame unit, as the rear support struts rotate forwards about their lower ends as the chair moves from its fully erect position to its TV position.

It should now be apparent that the reclining chair having pop-up headrest as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. In a reclining chair having:

a base arranged to be supported on a floor;

a seat and arm frame unit including at least one arm rest and a seat cushion for supporting a user when seated thereon;

a legrest for supporting the user's legs when said legrest is in an extended position;

a backrest for supporting the user's back; and a reclining chair mechanism which includes left and right side linkages of interpivoted links, said left and right side linkages being interconnected for coordinated movement by laterally connecting elements and by being secured at respective sites to transversally spaced sites on said base, said seat and arm frame unit, said legrest and said backrest, so as to support said seat and arm frame unit, said legrest and said backrest on said base, for progressive movement between:

a fully erect position, in which the legrest is stowed beneath a front portion of the seat cushion, the seat and arm frame unit are located relatively rearwards over said base, at a relatively elevated level and in which the seat cushion is positioned for the user's sitting and the backrest is relatively erect, and a TV position in which the legrest is raised and extended forwardly of the front portion of the seat, for supporting the user's legs off of the floor, and the seat and arm frame unit are lowered at the rear of the seat cushion and located relatively forwardly of its location over said base when in said fully erect position, each said side linkage of the mechanism including an upper longitudinal mounting flange to which a respective side of the seat and arm frame unit is mounted for support;

one of the base and each side linkage further including a lower longitudinal mounting flange;

the seat and arm frame unit being suspended above the base by front and rear support linkages of each of said side linkages, each of said rear support linkages including a generally vertical rear support strut which is pivoted at a lower end thereof to the respective said lower longitudinal mounting flange, for forward rotation about such lower end as said chair moves from said fully erect position to said TV position and for rearward rotation about such lower end as said chair moves from said TV position back to said fully erect position;

the legrest being suspended relative to the base on left and right front pantographic link assemblies forming respective portions of said side linkages, which front pantographic link assemblies extend forwardly from and retract rearwardly towards said base for extending and retracting said legrest; and the backrest being suspended relative to the base by being mounted at laterally opposite sides thereof, to backrest mounting links which form respective portions of said side linkages, each said backrest mounting link including an upwardly, rearwardly projecting leg;

the backrest including a frame having two laterally spaced longitudinally extending framing elements having upper ends, said framing elements being secured to respective ones of said legs of said backrest mounting links;

said backrest further including upholstered padding disposed and supported frontally on said framing elements, the improvement wherein said reclining chair further includes a pop-up headrest comprising:

said upholstered padding having a portion which extends above said upper ends of said framing elements and is movable between a folded-down position in which said upholstered padding portion extends generally horizontally, rearwardly over said upper ends of said framing elements, and a raised, or popped-up, position in which said padding portion extends generally vertically, frontally of said upper ends of said framing elements;

a laterally extending stiffener element secured to said upholstered padding portion so as to be effectively located on a rear face thereof when said headrest is in said popped-up position;

said side linkages each including a rear pantographic linkage assembly each effectively pivotally connected at an upper end thereof at respective forward and rear sites to said stiffener element at respective ends of said stiffener element;

said rear pantographic linkage assemblies each having two lower end links one of which effectively extends said upwardly projecting leg of the respective said backrest mounting link, and the other of which is pivotally effectively connected by a respective operator link to an intermediate-height location on the respective said rear support strut, whereby as said rear support struts rotate forwards about said lower ends thereof as said chair moves from said fully erect position to said TV position, such rotation is propagated along said rear pantographic linkage assemblies and thereby causes elevation of said rear sites of said upper ends of said rear pantographic linkage assemblies relative to said forward sites thereof, thereby erecting said headrest to said popped-up position.

2. The reclining chair improvement of claim 1, wherein:

said upholstered padding is integrally formed with said portion thereof which extends above said upper ends of said framing elements, and includes an integral, self-hinge about which said portion thereof rotates when moving between said folded-down and popped-up positions thereof.

3. The reclining chair improvement of claim 2, wherein:

said rear pantographic linkage assemblies are substantially fully enclosed within said backrest, except for portions which extend above said upper ends of said framing elements; said rear pantographic linkage assemblies being disposed inboard of and adjacent respective ones of said framing elements.

4. The reclining chair improvement of claim 1, on a reclining chair in which the mechanism further includes a fully reclined position, beyond said TV position, in which the legrest remains extended and the backrest is reclined relative to the seat and arm frame unit, wherein:

the rear pantographic linkage systems include geometric relationships at lower ends thereof which effectively provide lost motion between the headrest and the rear support struts as the chair moves from the TV position thereof to the fully reclined position thereof, and back, so that the headrest remains popped up until the chair, when in the TV position thereof, moves back towards the fully erect position thereof.

* * * * *